US009989338B2

(12) United States Patent
Osdon

(10) Patent No.: US 9,989,338 B2
(45) Date of Patent: Jun. 5, 2018

(54) FIN DEPLOYMENT SYSTEM

(71) Applicant: Israel Aerospace Industries Ltd., Lod (IL)

(72) Inventor: Tal Osdon, Lod (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 148 days.

(21) Appl. No.: 15/111,448

(22) PCT Filed: Feb. 24, 2015

(86) PCT No.: PCT/IL2015/050205
§ 371 (c)(1),
(2) Date: Jul. 13, 2016

(87) PCT Pub. No.: WO2015/128861
PCT Pub. Date: Sep. 3, 2015

(65) Prior Publication Data

US 2016/0349025 A1 Dec. 1, 2016

(30) Foreign Application Priority Data

Feb. 26, 2014 (IL) ..... 231186

(51) Int. Cl.
*F42B 10/16* (2006.01)

(52) U.S. Cl.
CPC ..... *F42B 10/16* (2013.01)

(58) Field of Classification Search
CPC ..... F42B 10/64; F42B 10/16; F42B 10/02; B64C 1/26; B64C 5/00; B64C 5/06; B64C 5/12; B64D 7/00
See application file for complete search history.

(56) References Cited

U.S. PATENT DOCUMENTS 1,376,785 A 5/1921 Sellmer
3,177,809 A 4/1965 Russell-French
(Continued)

FOREIGN PATENT DOCUMENTS

CN 102230765 11/2011
CN 202092524 12/2011
(Continued)

OTHER PUBLICATIONS

International Search Report and Written Opinion for PCT/IL2015/050205 dated Jun. 22, 2015.
(Continued)

*Primary Examiner* — Valentina Xavier
(74) *Attorney, Agent, or Firm* — Dorsey & Whitney LLP

(57) ABSTRACT

A fin deployment system for a projectile is provided, the fin deployment system defining a longitudinal axis and including: an actuator plate, a first mechanical stop arrangement, an actuation assembly, a plurality of fin assemblies, and a second mechanical stop arrangement. The actuator plate is pivotable from a first pivot position to a second pivot position about the longitudinal axis. The first mechanical stop arrangement is configured for initially locking the actuator plate at the first pivot position, and for selectively unlocking the actuator plate from the first pivot position responsive to an actuating force, to thereby allow the actuator plate to pivot to the second pivot position. The actuation assembly is for selectively applying the actuating force to the first mechanical stop arrangement, to thereby unlock the actuator plate from the first pivot position. Each fin assembly includes a fin pivotable from a stowed position to a deployed position about a respective fin hinge defining a respective deployment axis, each fin assembly forming a kinematic pair with the actuator plate such that the pivoting of the actuator plate between the first pivot position and the second pivot
(Continued)

position, and the pivoting of each fin from the respective the stowed position to the respective the deployed position, are concurrent. The second mechanical stop arrangement is for locking the fin assemblies in the respective deployed positions responsive to the actuator plate pivoting from the first pivot position to the second pivot position.

25 Claims, 11 Drawing Sheets

(56) References Cited

U.S. PATENT DOCUMENTS

| | | | | |
|---|---|---|---|---|
| 3,188,958 | A | 6/1965 | Burke et al. | |
| 3,260,205 | A * | 7/1966 | Dietrich | F42B 10/16 244/3.23 |
| 3,578,796 | A * | 5/1971 | Hagler | F42B 10/16 244/3.23 |
| 3,702,588 | A * | 11/1972 | Simmons | F42B 10/16 102/340 |
| 3,964,696 | A * | 6/1976 | Orzechowski | F42B 10/16 244/3.23 |
| 4,165,847 | A * | 8/1979 | Detalle | F42B 10/16 244/3.29 |
| 4,667,899 | A | 5/1987 | Wedertz | |
| 4,815,682 | A | 3/1989 | Feldmann et al. | |
| 5,046,424 | A | 9/1991 | Skowasch et al. | |
| 5,240,203 | A | 8/1993 | Myers | |
| 5,762,294 | A | 6/1998 | Jimmerson | |
| 5,950,963 | A | 9/1999 | Speicher et al. | |
| 6,073,880 | A | 6/2000 | Voigt et al. | |
| 6,168,111 | B1 | 1/2001 | Kayser et al. | |
| 6,352,217 | B1 | 3/2002 | Hsu et al. | |
| 6,454,216 | B1 | 9/2002 | Kiselev et al. | |
| 6,557,798 | B1 | 5/2003 | Giesenberg et al. | |
| 6,978,967 | B1 | 12/2005 | Scheper et al. | |
| 7,316,370 | B2 * | 1/2008 | Sankovic | F42B 10/64 244/3.27 |
| 7,728,266 | B2 * | 6/2010 | Melkers | F02K 1/78 244/3.24 |
| 8,367,993 | B2 * | 2/2013 | Velez | F42B 10/48 244/3.27 |
| 2003/0178527 | A1 | 9/2003 | Eisentraut et al. | |
| 2004/0021034 | A1 | 2/2004 | Hellman | |
| 2004/0216635 | A1 | 11/2004 | Henry et al. | |
| 2004/0217227 | A1 | 11/2004 | Alculumbre et al. | |
| 2005/0116091 | A1 | 6/2005 | Kelly | |
| 2006/0278754 | A1 | 12/2006 | Sankovic et al. | |
| 2008/0198060 | A1 | 8/2008 | Shani et al. | |
| 2012/0210901 | A1 | 8/2012 | Bender | |
| 2013/0087659 | A1 | 4/2013 | Prampolini | |
| 2014/0061365 | A1 * | 3/2014 | Roy | F42B 10/64 244/3.24 |

FOREIGN PATENT DOCUMENTS

| | | |
|---|---|---|
| DE | 3928965 | 3/1991 |
| EP | 298844 | 1/1989 |
| EP | 448437 | 9/1991 |
| FR | 1257613 | 4/1961 |
| GB | 2121147 | 12/1983 |
| RS | 20060630 | 11/2008 |

OTHER PUBLICATIONS

Daniels, P. et al., "Roll-Rate Stabilization of a Missile Configuration with Wrap-Around Fins in Incompressible Flow", Warfare Analysis Department, Naval Surface Weapons Center, Dahlgren Laboratory, Dahlgren, VA, Dec. 1975, 1-16.

* cited by examiner

FIN DEPLOYMENT SYSTEM

TECHNOLOGICAL FIELD

The presently disclosed subject matter relates to fin deployment systems, in particular for projectiles.

PRIOR ART

References considered to be relevant as background to the presently disclosed subject matter are listed below:

US 2012/0210901
U.S. Pat. No. 6,978,967
U.S. Pat. No. 3,177,809
US 2004/0216635
U.S. Pat. No. 6,352,217
U.S. Pat. No. 6,168,111
U.S. Pat. No. 6,073,880
U.S. Pat. No. 6,454,216
U.S. Pat. No. 4,667,899
U.S. Pat. No. 5,762,294
Roll Rate Stabilization of a Missile Configuration with Wrap-Around Fins in Incompressible Flow", Peter Daniels and Samuel R Hardy, December 1975

Acknowledgement of the above references herein is not to be inferred as meaning that these are in any way relevant to the patentability of the presently disclosed subject matter.

BACKGROUND

Cannon-fired projectiles are known, in which a cartridge case expels the projectile at high acceleration. In at least some cases, wrap-around fins are provided for such projectiles, and indeed other projectiles not necessarily cannon-launched, and many deployment systems are also known for such wrap-around fins.

GENERAL DESCRIPTION

According to an aspect of the presently disclosed subject matter there is provided a fin deployment system for a projectile, the fin deployment system defining a longitudinal axis and comprising:

an actuator plate, pivotable from a first pivot position to a second pivot position about the longitudinal axis;

a first mechanical stop arrangement, configured for initially locking the actuator plate at the first pivot position, and for selectively unlocking the actuator plate from the first pivot position responsive to an actuating force, to thereby allow the actuator plate to pivot to the second pivot position;

an actuation assembly for selectively applying the actuating force to the first mechanical stop arrangement, to thereby unlock the actuator plate from the first pivot position;

a plurality of fin assemblies, each fin assembly including a fin pivotable from a stowed position to a deployed position about a respective fin hinge defining a respective deployment axis, each fin assembly forming a kinematic pair with the actuator plate such that said pivoting of the actuator plate between the first pivot position and the second pivot position, and said pivoting of each fin from the respective said stowed position to the respective said deployed position, are concurrent; and a second mechanical stop arrangement for locking the fin assemblies in the respective deployed positions responsive to the actuator plate pivoting from the first pivot position to the second pivot position.

Herein, the terms "fins" are interchangeably used with the terms "vanes".

In at least some examples, the fin deployment system comprises an outer casing, and an inner support bracket internally mounted to outer casing, the fin assemblies being pivotably mounted to the outer casing about the respective deployment axes, and the actuation assembly being mounted to the inner support bracket.

For example, the inner support bracket comprises a plurality of struts or arms radially projecting from the longitudinal axis to an inner surface of the outer casing.

For example, the actuation assembly is configured for selectively applying the actuating force to the first mechanical stop arrangement along an axial direction parallel to the longitudinal axis, to thereby unlock the actuator plate from the first pivot position.

For example, the actuation assembly comprises an actuation piston, axially displaceable with respect to the inner support bracket from a first axial position to a second axial position. For example, the actuation assembly comprises a pyrotechnic component operable for selectively displacing the actuation piston to the second axial position when fired. For example, the first mechanical stop arrangement comprises a pin support bracket carrying at least one pin and mounted with respect to the inner support bracket to prevent relative rotation of the pin support bracket about the longitudinal axis, the at least one pin being engaged in a complementary hole provided in the actuator plate when the actuator plate is in the first pivot position to thereby lock the actuator plate with respect to the inner support bracket in the first pivot position, the pin support bracket being selectively axially displaceable responsive to actuation of the actuation piston to disengage the at least one pin from the complementary hole and to thereby unlock the actuator plate from the first pivot position. For example, the at least one pin also passes through a complementary axial opening in the inner support bracket to thereby prevent relative rotation of the pin support bracket about the longitudinal axis. For example, the pin support bracket is affixed to one end of the actuation piston, and wherein in said first axial position the at least one pin is engaged in the complementary hole, and wherein in said second axial position, the at least one pin is disengaged from the complementary hole.

For example, the second mechanical stop arrangement is configured for locking the fin assemblies in the respective deployed positions responsive to the actuator plate pivoting from the first pivot position to the second pivot position, by mechanically locking the actuator plate in the second pivot position. For example, the second mechanical stop arrangement comprises at least one first tooth provided on the actuator plate in general overlying abutting relationship with at least one second tooth provided on the inner support bracket, each said first tooth and said second tooth having a respective moderate slope and a respective steep slope, wherein in said first pivot position the respective moderate slopes are in abutting contact, permitting relative rotation between the actuator plate and the inner support bracket about the longitudinal axis to the second pivot position, and wherein in said second pivot position, the respective steep slopes of the first tooth and the second tooth are in abutting contact, preventing relative rotation between the actuator plate and the inner support bracket from the second pivot position to the first pivot position. For example, the fin deployment system further comprises a biasing spring for biasing the actuator plate towards the inner support bracket.

For example, the biasing spring has a first axial end abutting a stop provided on the actuation assembly, and a second axial end abutting the actuator plate. For example, the biasing spring further biases the respective steep slopes of the first tooth and the second tooth into abutting contact in said second pivot position.

For example, the actuation plate is pivotably mounted with respect to the inner support bracket.

For example, the actuator plate comprises a plurality of radial through-slots corresponding to the plurality of fin assemblies, each fin assembly comprising an actuating arm rigidly mounted to a root of the respective fin and comprising an axial pin or rod, spaced from the fin root, the axial pin or rod being received in the respective said through-slot and radially movable with respect to the respective slot concurrently with pivoting of the actuator plate from the first pivot position to the second pivot position to thereby concurrently pivot the respective fin from the stowed position to the deployed position. For example, the actuator plate is axially movable concurrent with pivoting of the actuator plate from the first pivot position to the second pivot position For example, the fin deployment system further comprise a torque applicator configured for applying a driving torque to at least one of the actuator plate and the plurality of fin assemblies, to thereby pivot the actuator plate from the first pivot position to the second pivot position, responsive to the actuator plate being unlocked from the first pivot position.

For example, the torque applicator comprises at least one of a torsion bar or torsion spring at each fin hinge and pre-stressed or otherwise biased to apply the driving torque to the respective fin assembly, to thereby pivot the respective fin to the deployed position, and concurrently pivot the actuator plate from the first pivot position to the second pivot position, responsive to the actuator plate being unlocked from the first pivot position. For example, when the torque applicator is twisted, it exerts a torque in the opposite direction to the twist, proportional to the twist angle.

Additionally or alternatively, the torque applicator comprises at least one of a torsion bar or torsion spring coupled to the actuator plate, and pre-stressed or otherwise biased to apply the driving torque to the actuator plate, to thereby pivot the actuator plate from the first pivot position to the second pivot position, responsive to the actuator plate being unlocked from the first pivot position, and concurrently pivot the fins to the respective deployed positions.

For example, the fins are wrap-around fins having a first side and a second side, wherein in the respective stowed configuration the respective fins are in wrapped configuration, wherein said first sides of the fins are in overlying relationship with the outer casing, and wherein in said deployed configuration, the fins project generally radially with respect to the longitudinal axis.

For example, the deployment axes are parallel to, and radially spaced from, said longitudinal axis.

For example, each fin comprises an elongate curved body. Alternatively, the fin body can be substantially flat, at least when deployed.

For example, in the stowed position, the fins are cylindrically disposed over the outer casing to provide a cylindrical body having a diameter of 120 mm or about 120 mm.

According to this aspect of the presently disclosed subject matter there is also provided a projectile, comprising at least one fin deployment system as defined herein according to this aspect of the presently disclosed subject matter. For example, the projectile is configured for being cannon-launched. For example, the projectile is a 120 mm gun munition.

For example, one said fin deployment system is located at the center of gravity of the projectile.

Additionally or alternatively, one said fin deployment system is located in an aft portion of the projectile.

A feature of at least some examples of the fin deployment system is that the fins are reversibly locked in the stowed position using a relatively simple mechanical stop.

Another feature of at least some examples of the fin deployment system is that the fins are locked in the deployed position using a relatively simple mechanical stop.

Another feature of at least some examples of the fin deployment system is that the fins can be deployed from the stowed position to the deployed position in a relatively fast manner.

Another feature of at least some examples of the fin deployment system is that the fins can be deployed from the stowed position to the deployed position in a controlled manner.

BRIEF DESCRIPTION OF THE DRAWINGS

In order to better understand the subject matter that is disclosed herein and to exemplify how it may be carried out in practice, examples will now be described, by way of non-limiting example only, with reference to the accompanying drawings, in which.

DETAILED DESCRIPTION

Figure 1A:
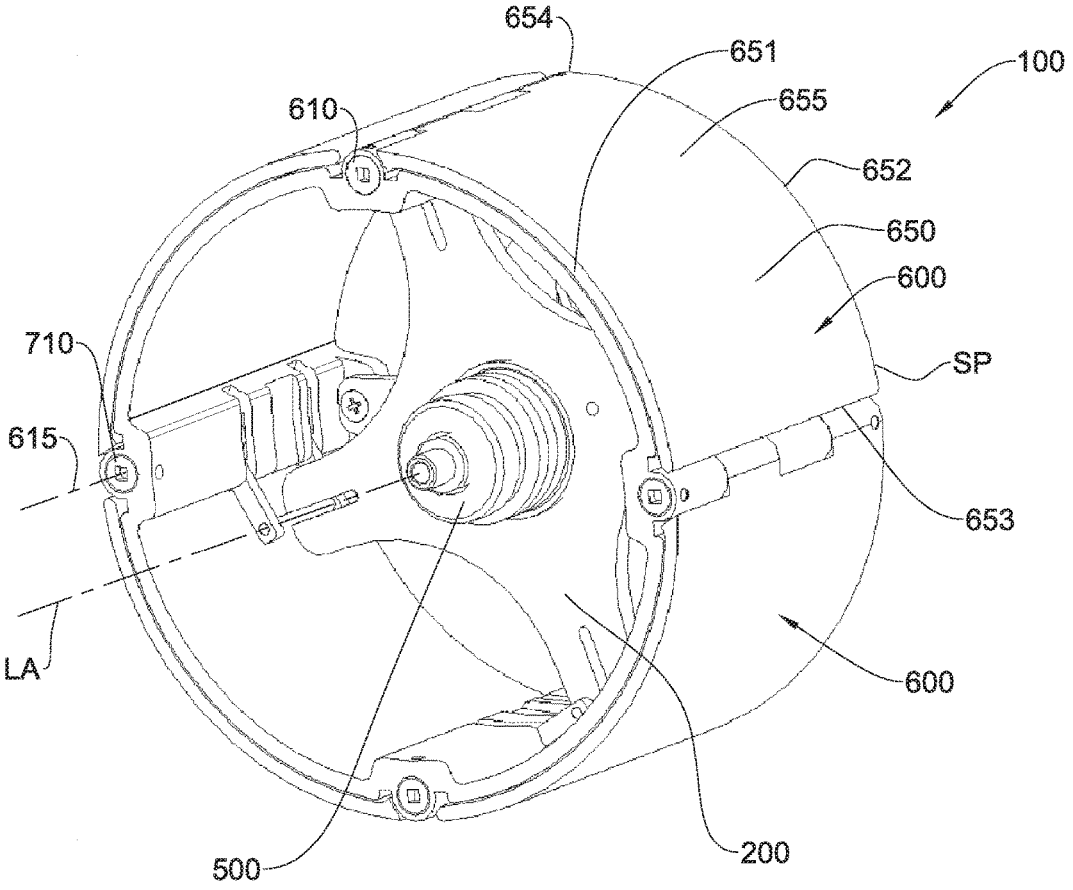
FIG. 1(*a*) and FIG. 1(*b*) are each a front isometric view of a fin deployment system according to a first example of the presently disclosed subject matter, in stowed configuration and deployed configuration, respectively.
Figure 1B:
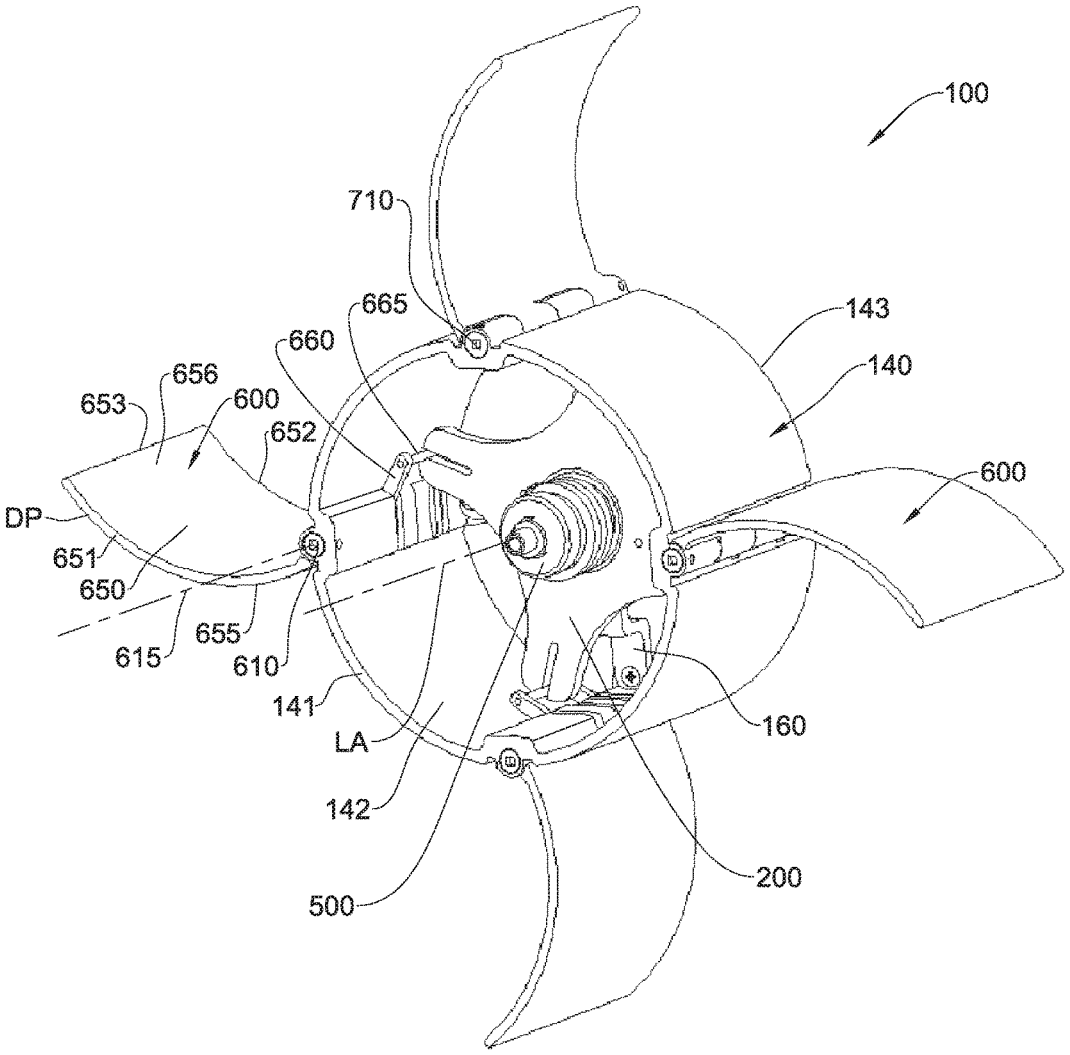

Referring to FIGS. 1(*a*) to 6(*b*), a fin deployment system according to a first example of the presently disclosed subject matter, generally designated 100, comprises an actuator plate 200, a first mechanical stop arrangement 300, a second mechanical stop arrangement 400, an actuation assembly 500 and a plurality of fin assemblies 600.

As will become clearer herein, the fin deployment system 100 operates to deploy a plurality of fins 650 from a stowed configuration (also referred to herein interchangeably as the stowed position), illustrated for example in FIG. 1(*a*), to a deployed configuration (also referred to herein interchangeably as the deployed position), illustrated for example in FIG. 1(*b*); furthermore, the fin deployment system 100 is configured for maintaining the fins 650 in the stowed configuration until the fin deployment system 100 is operated to deploy the fins 650, and for locking the fins 650 in the deployed configuration after deployment. In this example, in the stowed position, the fins 650 are cylindrically disposed over the outer casing 140 to provide a cylindrical body, for example having a diameter of 120 mm or about 120 mm.

Figure 7:
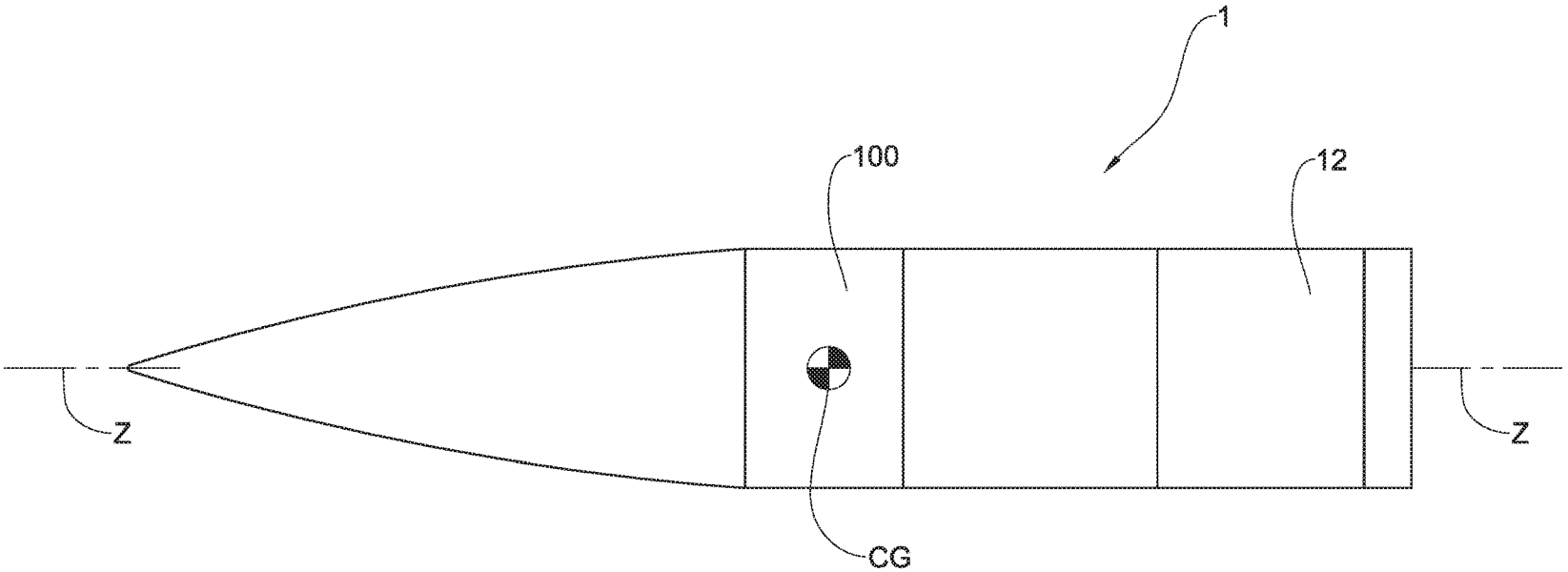
FIG. 7 shows in side view a projectile including a system according to the example illustrated in FIGS. 1(*a*) to 6(*b*).

Referring to FIG. 7, the fin deployment system 100 can be comprised in a projectile 1, for example at the center of gravity CG of the projectile. In this example, such a projectile 1 can be cannon fired, and for example is in the form of 120 mm gun munition, i.e., having an external diameter of nominally 120 mm, in which case the respective fin deployment system 100 also has an external diameter 120 mm when in the stowed configuration; in alternative variations of this example, can be in the form of cannon-fired gun munition of diameter greater than 120 mm or less than 120 mm. As used herein, "cannon-fired" refers to the projectile being launched from a cannon, by means of a cartridge and/or a rocket engine. The term "cannon" is herein take to include guns, mortars, artillery cannons, tank cannons, howitzers, guns, and any other tubular structures used for launching projectiles. Additionally or alternatively, a fin deployment system 100 can be located in an aft portion 12 of the projectile 1.

In this example, the projectile is configured for travelling in a gaseous medium such as the atmosphere. However, in alternative variations of this example, the projectile is configured for travelling in a liquid medium such as the sea, for example, and can be in the form of a torpedo, for example.

The fin deployment system 100 defines a longitudinal axis LA, which in this and in other examples is co-axial with the longitudinal axis Z of the projectile 1.

Referring in particular to FIG. 1(*b*), the fin deployment system 100 comprises an outer casing 140 and an inner support bracket 160 internally mounted to the outer casing 140. In this example, the outer casing is generally tubular, including a tubular wall 142 and forward and aft ends 141, 143 configured for mating with other components of the projectile 1, for example other parts of the projectile body. In this example, and referring also to FIG. 3(*a*), the support bracket 160 is in the form of a cruciform member, having four struts or arms 165 projecting from a central plate portion 166, centered on the longitudinal axis LA, and the free ends 164 of the arms 165 are fixed to an inner surface of the outer casing, i.e., to the tubular wall 142.

While in this example, the fin deployment system 100 comprises four fin assemblies 600, in alternative variations of this example the fin deployment system can comprise two, three, or more than four fin assemblies. In any case, in this example and in other examples, the fin assemblies 600 are uniformly distributed circumferentially with respect to the outer casing 140.

Referring in particular to FIGS. 1(*a*), 1(*b*), 2(*b*) and 5(*b*), each fin assembly 600 comprises a fin 650, which in this example is in the form of a wrap-around fin, having an elongate curved body, with curvuate leading edge 651, curvuate trailing edge 652, fin tip 653, fin root 654, convex fin side 655 and concave fin side 656. Each fin 650 is pivotably mounted to the outer casing 140 via a fin hinge 610, which defines a pivoting axis for the fin designated herein as the deployment axis 615. The deployment axes 615 are parallel to, and radially spaced from, the longitudinal axis LA.

Each fin 650 is pivotable from a stowed position SP (illustrated in FIGS. 1(*a*) and 2(*a*), for example) to a deployed position DP (illustrated in FIGS. 1(*b*) and 2(*b*), for example) about the respective deployment axis 615, via the respective fin hinge 610. Thus, in the respective stowed configuration the respective fins 650 are in wrapped configuration, wherein the concave fin surface 656 of the fins 650 are in overlying relationship with the outer casing 140, and wherein in the deployed configuration, the fins 650 project generally radially with respect to the longitudinal axis LA.

Referring in particular to FIGS. 1(*b*), 2(*b*) and 5(*b*), each fin assembly 600 further comprises a pair of actuating arms 660 rigidly mounted to the fin root 654 and axially spaced from one another. The arms 660 carry an axial pin or rod 665 spaced from the fin root 654 by a length L via the arms 650, which project from the fin root 654 in a direction generally opposed to that of the respective fin 650 from the fin root 654. The rods 665 have an axial length H, and in this example are generally parallel to the deployment axis 615. In alternative variations of this example, one actuating arm, or more than two actuating arms can be rigidly mounted to the fin root 654, rather than two arms, to thereby support the rod 665 in the aforesaid spaced relationship from the respective deployment axis 615.

Figure 2A:
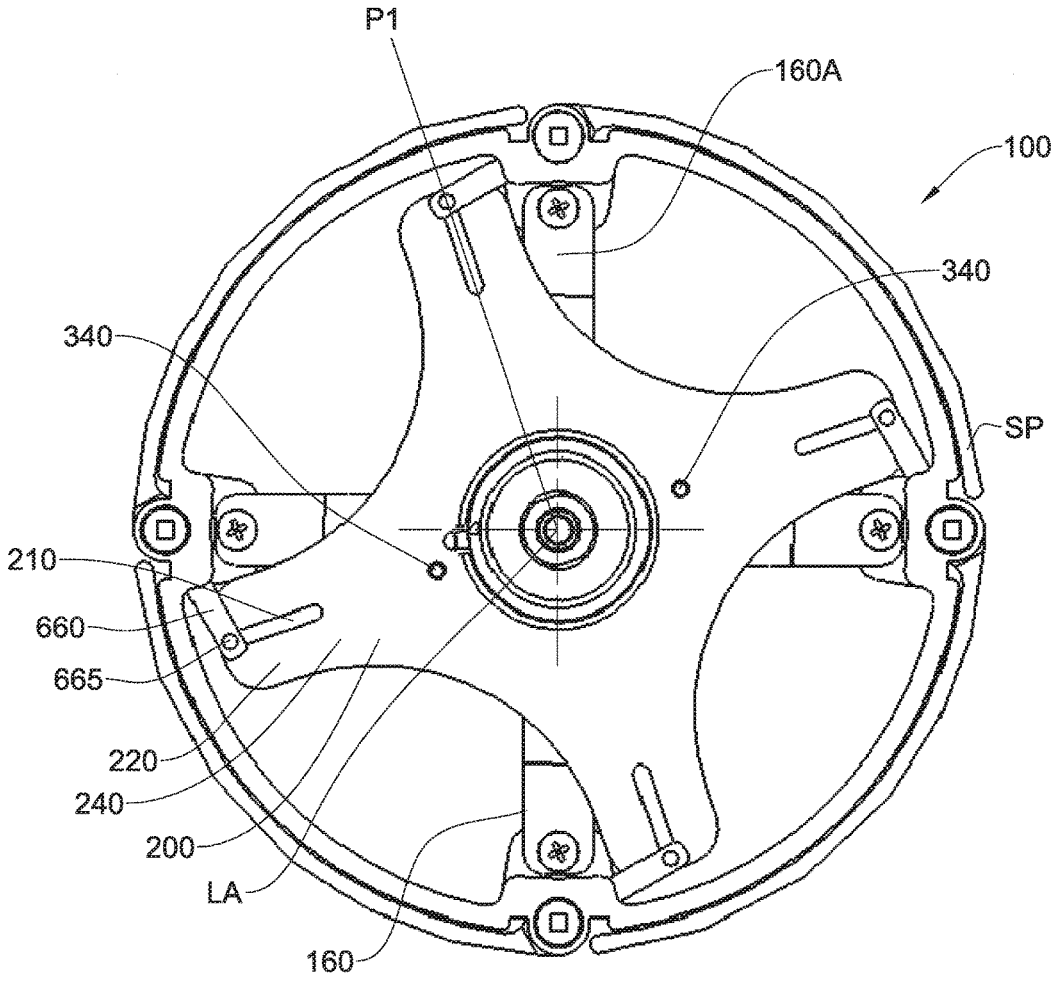
FIG. 2(*a*) and FIG. 2(*b*) are each a front view of the example of FIG. 1(*a*) and FIG. 1(*b*), in stowed configuration and deployed configuration, respectively.
Figure 2B:
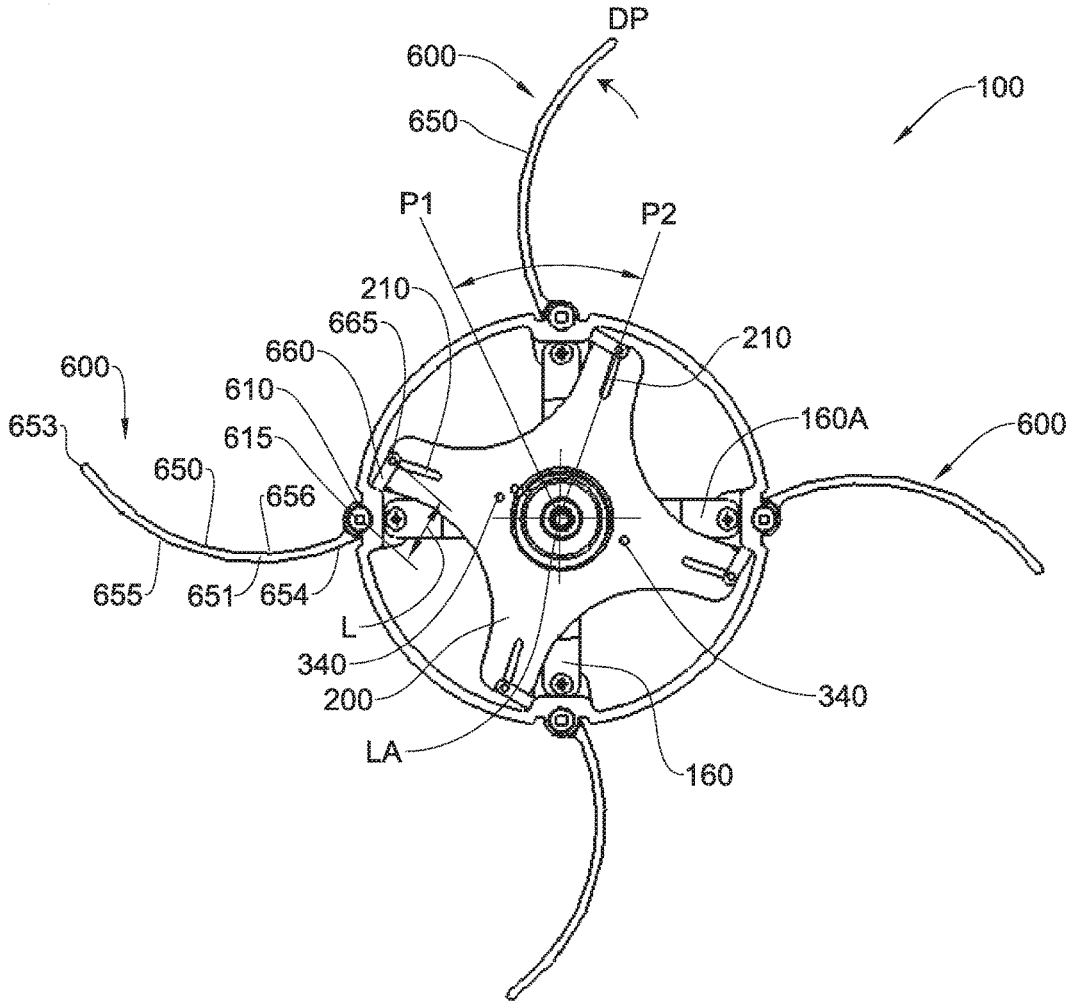

Referring in particular to FIGS. 2(*a*) and 2(*b*), the actuator plate 200 is pivotably mounted with respect to the inner support bracket 160, in axially facing relationship with a first side 160A of the inner support bracket 160.

The actuator plate 200 is pivotable with respect to the inner support bracket 160 from a first pivot position P1 to a second pivot position P2 about the longitudinal axis LA. The actuator plate 200 has a general cruciform profile in top view, with four arms 220 (corresponding to the number of fin assemblies 600) projecting from a central portion 240, centered on the longitudinal axis LA. In alternative variations of this example, the actuator plat can have any suitable form, for example a disc or polygonal shape.

Each fin assembly 600 forms a kinematic pair with the actuator plate 200 such that pivoting of the actuator plate between the first pivot position P1 and the second pivot position P2, and the pivoting of each fin from the respective stowed position SP to the respective deployed position DP, are concurrent.

Figure 5A:
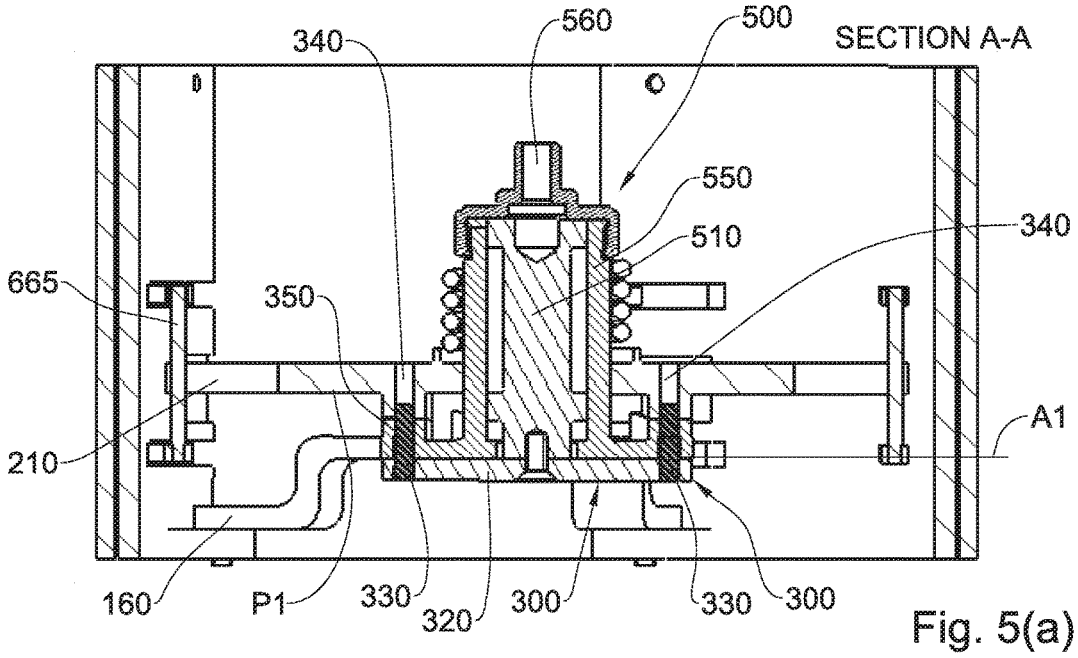
FIG. 5(*a*) and FIG. 5(*b*) are each a side cross-sectional view of the example of FIG. 4(*a*) and FIG. 4(*b*), along A-A and B-B, respectively.
Figure 5B:
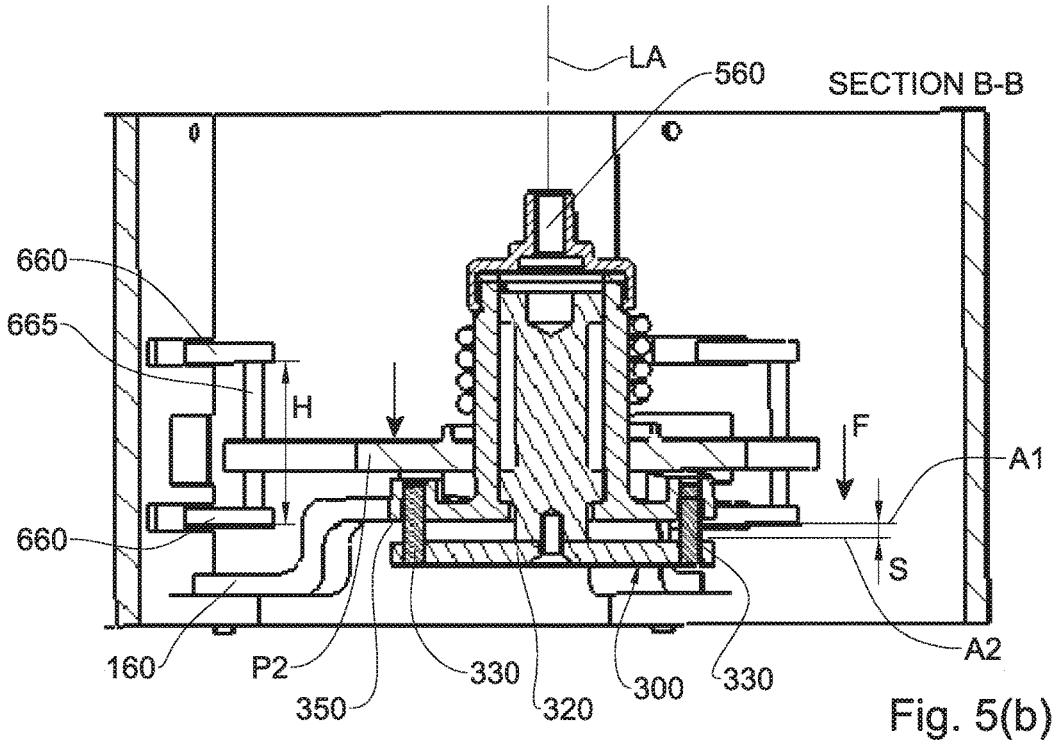

The kinematic pairs are formed by the mechanical coupling between the actuator plate 200 and each of the fin assemblies 600. In particular the actuator plate 200 comprises four radial through-slots 210 corresponding to the number of fin assemblies 600, that couple with the rods 665 to provide the coupling between the actuator plate 200 and the fin assemblies 600. Each slot 210 extends from the tip of the respective an 220 towards the longitudinal axis LA, and is sized to receive the rod 665 of the corresponding fin assembly 600, and to allow the rod 665 to radially slide in the slot 210, the rod 665 being in orthogonal relationship to the radial slot direction, as best seen in FIG. 5(*a*). In alternative variations of this example in which there is one, two, three or more than four, or any other plurality of fin assemblies, the actuator plate 200 comprises a corresponding plurality of radial through-slots.

Each rod 665 is thus received in the respective through-slot 210 and radially and reciprocally movable (with respect to the longitudinal axis LA) along the respective slot 210, concurrently with pivoting of the actuator plate 200 from the first pivot position P1 to the second pivot position P2, to thereby concurrently pivot the respective fin 650 from the stowed position SP to the deployed position DP. It is to be noted that the actuator plate 200 is also axially movable, i.e. along the longitudinal axis LA concurrent with pivoting of the actuator plate 200 from the first pivot position P1 to the second pivot position P2, as best seen in FIGS. 5(*a*) and 5(*b*).

Figure 3A:
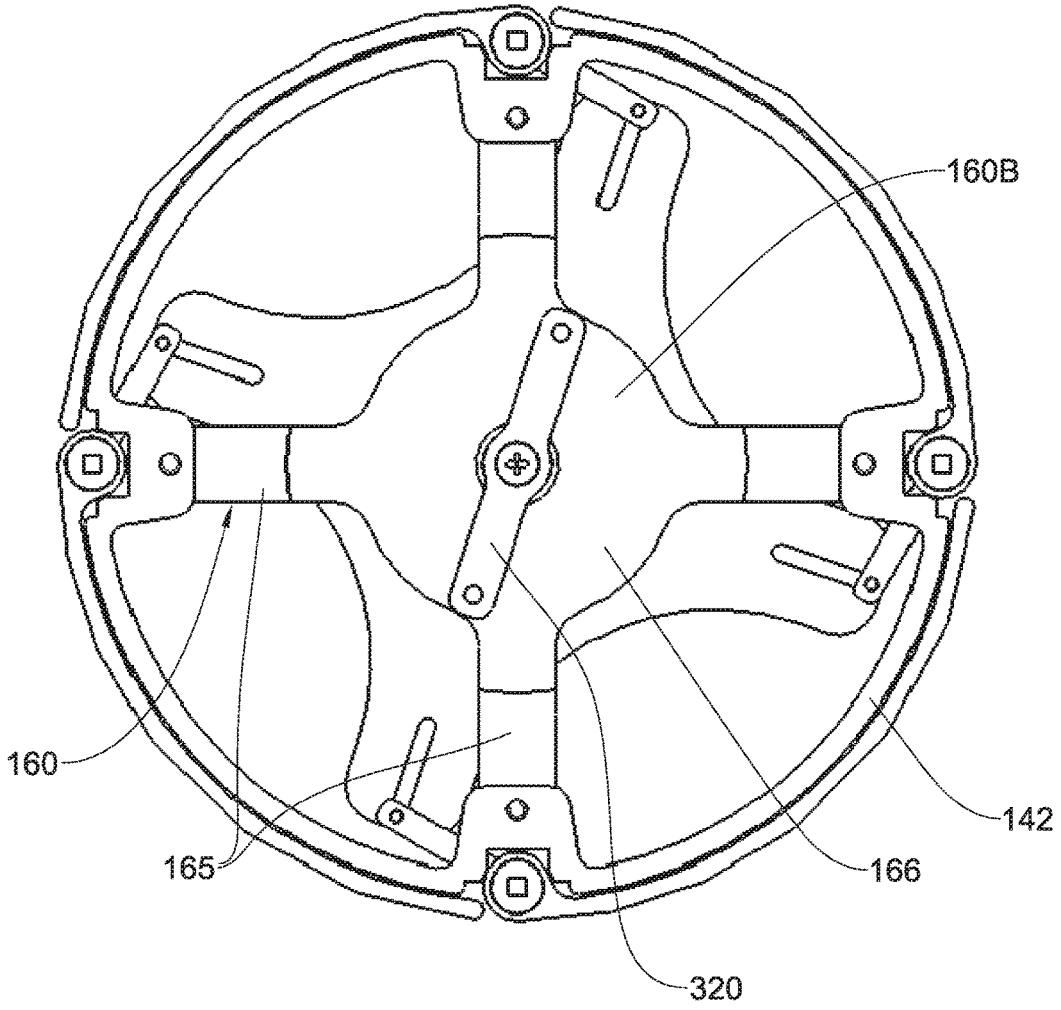
FIG. 3(*a*) and FIG. 3(*b*) are each a back view of the example of FIG. 1(*a*) and FIG. 1(*b*), in stowed configuration and deployed configuration, respectively.
Figure 3B:
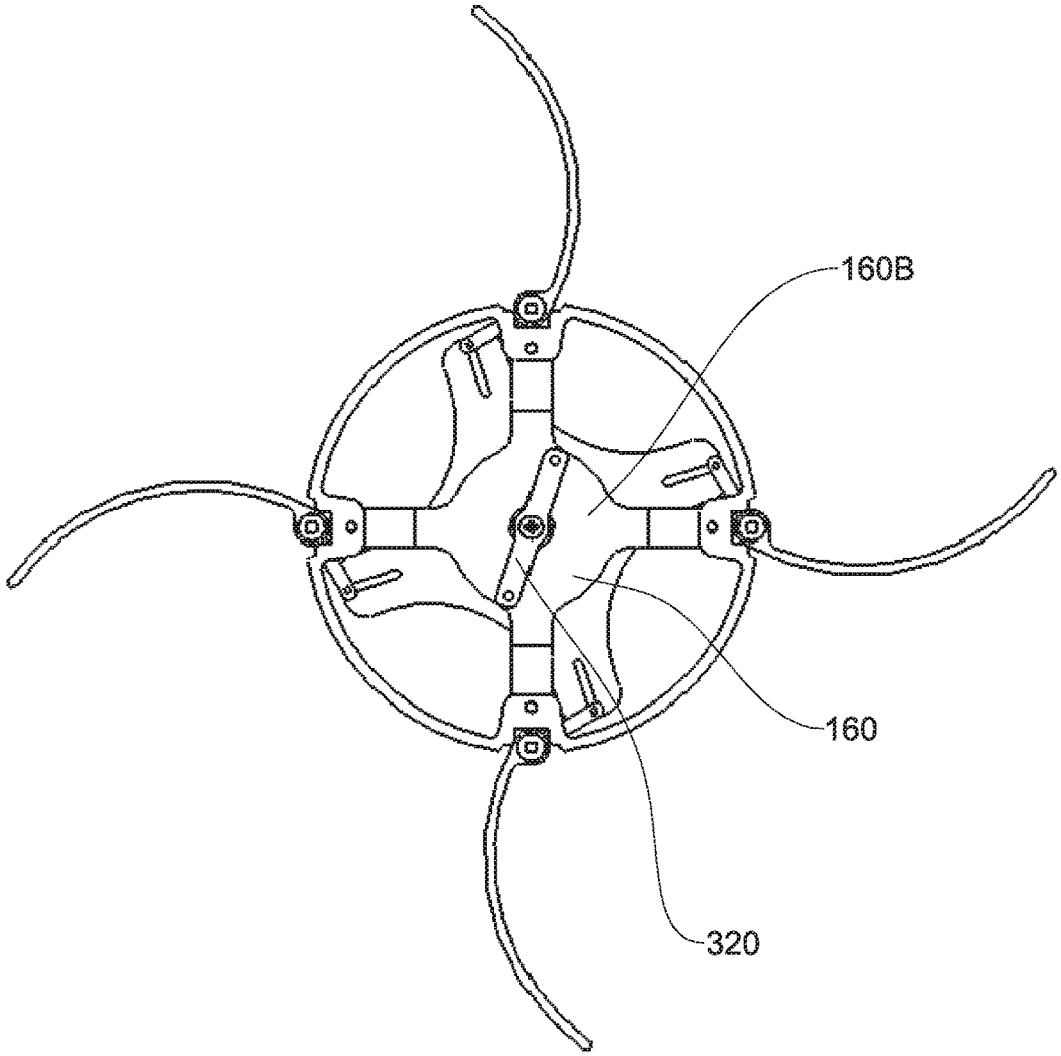

Referring in particular to FIGS. 3(*a*), 3(*b*), 5(*a*) and 5(*b*), the first mechanical stop arrangement 300 (also referred to interchangeably herein as a first locking arrangement) is configured for initially locking the actuator plate 200 at the first pivot position P1, and for selectively unlocking the actuator plate 200 from the first pivot position P1 responsive to an actuating force F, provided by the actuation assembly 500 in this example, being applied to the first mechanical stop arrangement 300, to thereby allow the actuator plate 200 to pivot to the second pivot position P2.

In this example, the first mechanical stop arrangement 300 comprises a pin support bracket 320, carrying two pins 330 rigidly attached thereto and projecting in a direction towards the support bracket 160. In alternative variations of this example, the pin support bracket can instead carry one pin or more than two pins.

As can seen in FIGS. 3(*a*) and 3(*b*), the pin support bracket 320 is movably mounted with respect to the inner support bracket 160, in axially facing relationship with a second side 160B of the inner support bracket 160, on the other side of the inner support bracket with respect to the actuator plate 200.

Referring also to FIGS. 2(*a*) and 2(*b*), each of the pins 330 is engaged in a complementary hole 340 provided in the actuator plate 200 when the actuator plate 200 is in the first pivot position P1, to thereby lock the actuator plate 200 with respect to the inner support bracket 160 in the first pivot position P1. The pin support bracket 330 is selectively axially displaceable by an axial displacement s (FIG. 5(*b*)) along the longitudinal axis LA, to thereby disengage the pins 330 from the complementary holes 340 and thus unlock the actuator plate 200 from the first pivot position P1, and allow pivoting to the second pivot position P2. This axial displacement s is selectively provided via actuation of the actuation assembly 500.

Figure 4A:
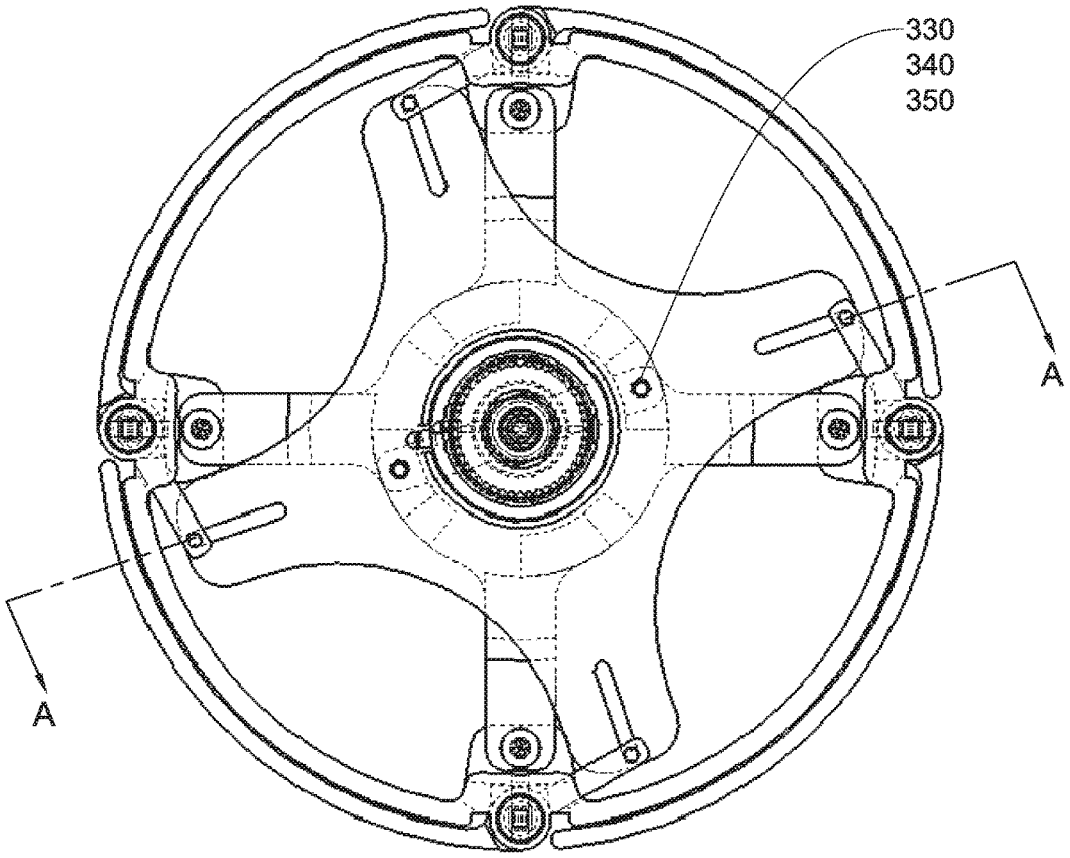
FIG. 4(*a*) and FIG. 4(*b*) are each a front view of the example of FIG. 1(*a*) and FIG. 1(*b*) showing hidden lines, in stowed configuration and deployed configuration, respectively.
Figure 4B:
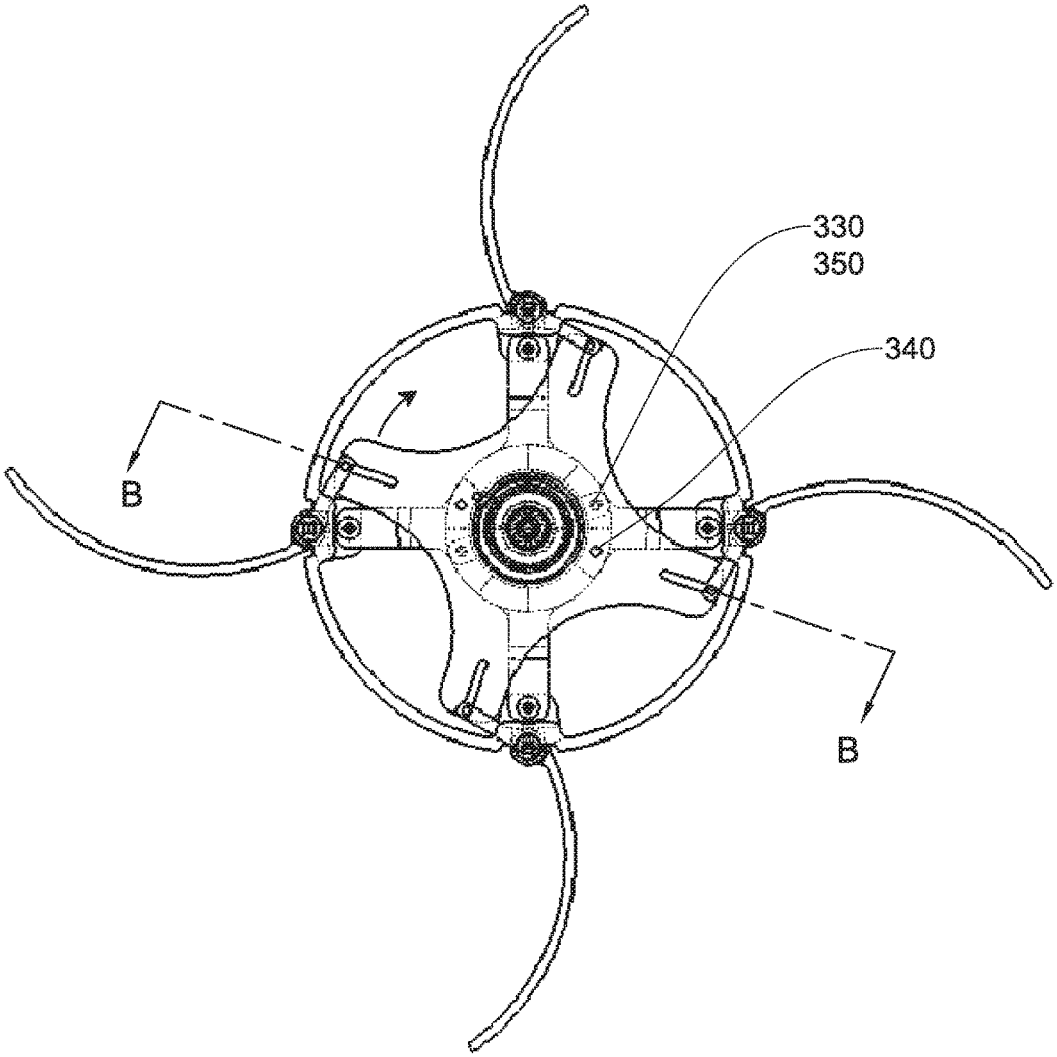

As can also be seen in FIGS. 3(*a*) and 3(*b*), the pin support bracket 320 is movably mounted with respect to the inner support bracket 160 in a manner that prevents relative rotation of the pin support bracket 320 about the longitudinal axis LA, even as the actuator plate 200 is pivoted from the first pivot position P1 to the second pivot position P2. In this example, and referring to FIGS. 5(*a*) and 5(*b*), the pins 330 are slidably engaged in, and pass through, complementary axial openings 350 provided in the inner support bracket 160 to thereby prevent relative rotation of the pin support bracket about the longitudinal axis LA. Thus, and referring also to FIGS. 4(*a*) and 4(*b*), when the actuator plate 200 is in the first pivot position P1, the pins 330 pass through the corresponding axial openings 350 and into the holes 340 to thereby lock the actuator plate 200 in the first pivot position P1, which concurrently locks the fin assemblies 600 in the stowed position SP due to the coupling therebetween. On the other hand, in response to axial displacement s, the pins 330 disengage from the holes 340 in the actuator plate 200, while still engaged to the corresponding axial openings 350, thereby unlocking the actuator plate 200 from the first pivot position P1, and thereby concurrently unlocking the fin assemblies 600 from the stowed position SP due to the coupling therebetween.

Referring in particular to FIGS. 5(*a*) and 5(*b*), the actuation assembly 500 is configured for selectively applying the actuating force F to the first mechanical stop arrangement 300 along an axial direction parallel to the longitudinal axis LA, to thereby provide the aforesaid displacement s to the pins 330, which in turn unlocks the actuator plate 200 from the first pivot position P1. In this example, the actuation assembly 500 comprises an actuation piston 510, axially displaceable within a piston housing 550, which is fixedly mounted to the inner support bracket 160, and aligned along the longitudinal axis LA. Thus, the actuation piston 510 is axially displaceable (in a direction parallel to the longitudinal axis LA) with respect to the inner support bracket 160 from a first axial position A1 (illustrated in FIG. 5(*a*)) to a second axial position A2 (illustrated in FIG. 5(*b*)), which are spaced by displacement s.

The actuation assembly 500 comprises a pyrotechnic component 560 operable for selectively displacing the actuation piston to the second axial A2 position when fired. For example, the pyrotechnic component 560 can comprise a squib provided at one end of the piston housing 550, and configured for providing, in response to a control command signal, a controlled explosion to thereby provide high pressure gases at one end of the piston 510, thereby driving the piston 510 axially to the second axial position A2.

The pin support bracket 320 is affixed to one end of the actuation piston 510, and thus when the piston 510 is in the first axial position A1, each pin 330 is engaged in the complementary hole 340, whereas when the piston 510 is in the second axial position A2, each pin 330 is disengaged from the complementary hole 340.

In alternative variations of this example, the actuation assembly can instead comprise a plurality of actuating pistons, and/or each actuating piston can be actuated in a different manner, for example pneumatically, hydraulically, or electrically, to thereby displace the pins 330 from engagement with to disengagement from, the actuation plate 200.

The second mechanical stop arrangement 400 is configured for locking the fin assemblies 600 in the respective deployed positions DP responsive to the actuator plate 200 pivoting from the first pivot position P1 to the second pivot position P2, in this example by mechanically locking the actuator plate 200 in the second pivot position P2.

Figure 6A:
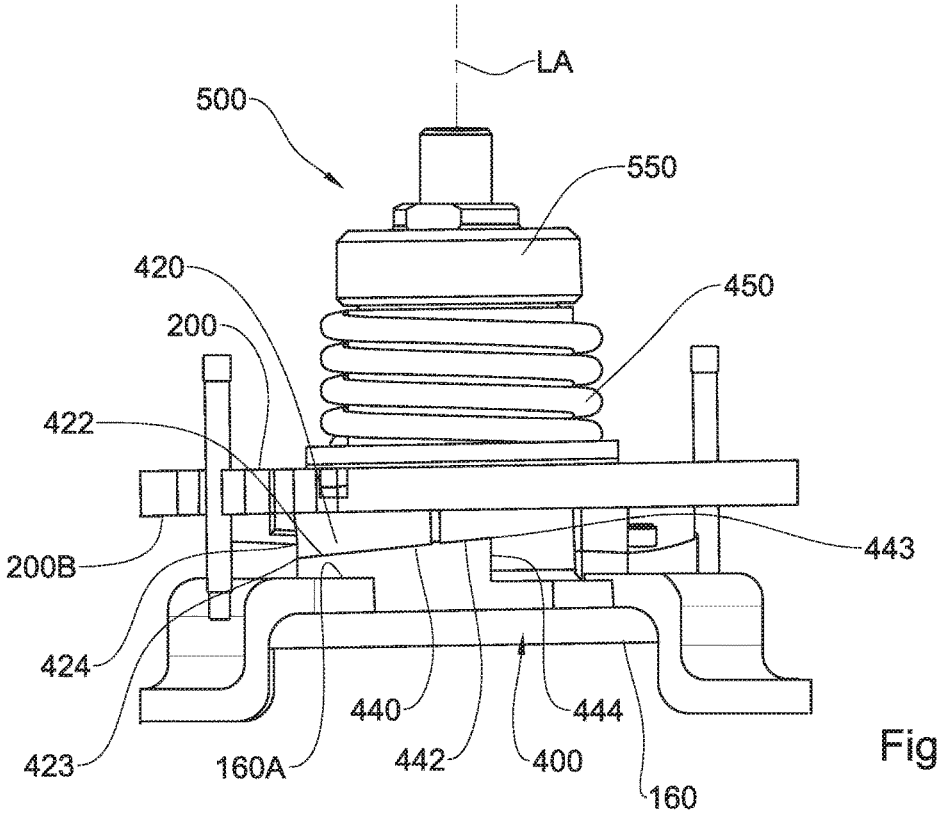
FIG. 6(*a*) and FIG. 6(*b*) are each a partial side view of the example of FIG. 1(*a*) and FIG. 1(*b*), in stowed configuration and deployed configuration, respectively.
Figure 6B:
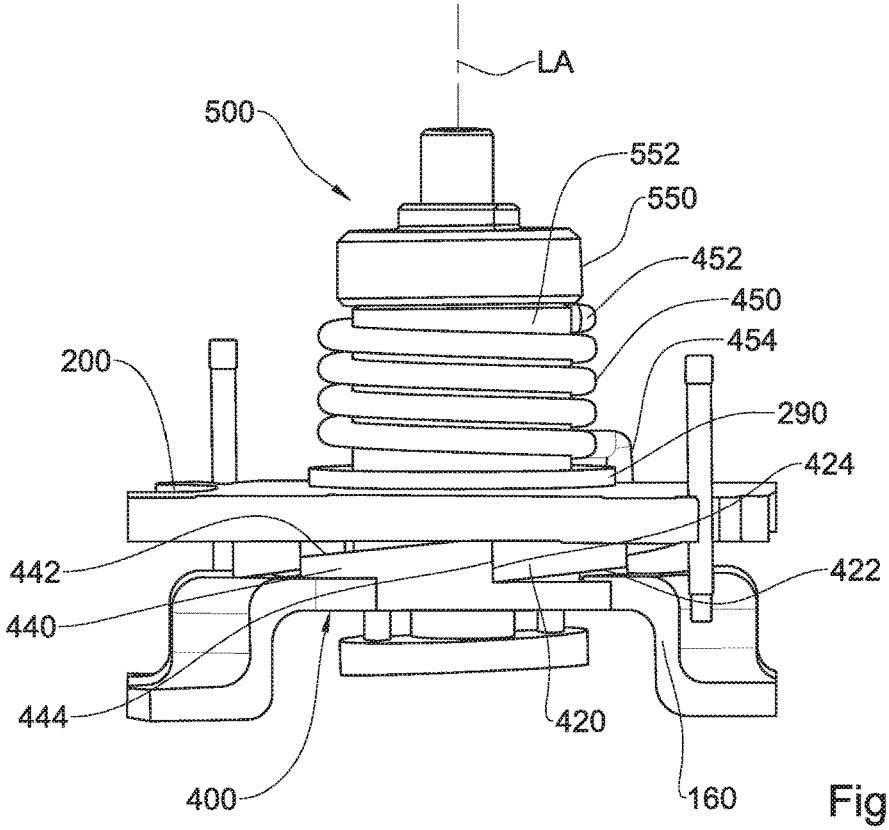

Referring to FIGS. 6(*a*) and 6(*b*) in particular, the second mechanical stop arrangement 400 (also referred to interchangeably herein as a second locking arrangement) comprises a plurality of first teeth 420 provided on the actuator plate 200, in general overlying abutting relationship with a plurality of second teeth 440 provided on the inner support bracket 160. Each first tooth 420 is wedge-shaped and projects from the lower surface 200B of the actuator plate 200 (facing the inner support bracket 160), having a moderate slope 422 and a steep slope 424 that meet at an apex 423. Similarly, each second tooth 440 is also wedge-shaped and projects from the upper surface 160A of the inner support bracket 160 (facing the actuator plate 200), having a moderate slope 442 and a steep slope 444 that meet at apex 443. In the first pivot position P1, the respective moderate slopes 422, 442 of pair each of aligned first teeth 420 and second teeth 440, are in at least partial overlapping relationship (when viewed in a direction parallel to the longitudinal axis LA) and in abutting contact, permitting relative rotation between the actuator plate 200 and the inner support bracket 160 about the longitudinal axis LA to the second pivot position P2, as illustrated in FIG. 6(*a*). Concurrent with this pivoting, the actuator plate 200 moves axially in a direction parallel to the longitudinal axis LA. In the second pivot position P2, after the apices 423, 443 have passed one another, the actuator plate 200 moves back axially in the opposite direction, and the respective steep slopes 424, 444 of the first tooth 420 and the second tooth 440 are now in abutting contact, preventing relative rotation between the actuator plate 200 and the inner support bracket 160 back from the second pivot position P2 to the first pivot position P1, as illustrated in FIG. 6(*b*). It is to be noted that in alternative variations of this example, the second mechanical stop arrangement 400 comprises one first tooth 420 provided on the actuator plate 200, in general overlying abutting relationship with one second tooth a plurality of second teeth 440.

The fin deployment system 100, and in particular the second mechanical stop arrangement 400, further comprises a biasing spring 450 for biasing the actuator plate 200 towards the inner support bracket 160. The biasing spring 450 is in the form of a coil spring, coaxial with the longitudinal axis LA and located on an outside of the piston housing 550. The biasing spring 450 has a first axial end 452 abutting a first stop 552 provided on the actuation assembly 500 (in particular on the piston housing 550), and a second axial end 454 abutting the actuator plate 200 at a second stop 290. The biasing spring 450 is pre-stressed, so that is presses the actuation plate 200 towards the inner support bracket 160. Furthermore, in operation, the biasing spring 450 also biases the respective steep slopes 424, 444 of each pair of first teeth and the second teeth into abutting contact in the second pivot position P2—essentially, pivoting of the actuating plate 200 from the first pivot position P1 to the second pivot position P2 winds the biasing spring 450 about the longitudinal axis LA, and stores additional energy in the spring.

In this example, the system 100 further comprises a torque applicator 700, configured for applying a driving torque to at least one of the actuator plate 200 and the plurality of fin assemblies 600, to thereby pivot the actuator plate 200 from the first pivot position P1 to the second pivot position P2, responsive to the actuator plate 200 being unlocked from the first pivot position P1. In the illustrated example, applicator 700 applies the driving torque directly to the fin assemblies 600, to pivot the fin assemblies from the stowed position SP to the deployed positions DP, responsive to the actuator plate 200 being unlocked from the first pivot position P1. Concurrently, by being coupled to the actuator plate 200, the deployment of the fin assemblies 600 pivots the actuator plate 200 from the first pivot position P1 to the second pivot position, P2. In this example, the torque applicator 700 comprises a torsion bar 710 at each fin hinge 610, as best seen in FIGS. 1(*a*) and 1(*b*). Each torsion bar 710 is pre-stressed, and thereby biased, to apply the required driving torque to the respective fin assembly 600, to thereby pivot the respective fin 650 to the deployed position DP, and concurrently pivot the actuator plate 200 from the first pivot position P1 to the second pivot position P2, responsive to the actuator plate 200 being unlocked from the first pivot position P1. Each torsion bar 710 is thus pre-twisted in the stowed position SP, and exerts a torque on the respective fin assembly 600 in the opposite direction to the twisting, and proportional to the twist angle; thus, the twisting angle and material and profile of the torsion bars 710 is chosen to provide the required torque. Alternatively, the torsion bars can be replaced with torsion springs, or any other suitable torque generating arrangement. Alternatively, for example, the torque applicator can comprise at least one of a hydraulic, pneumatic or pyrotechnic actuator, suitably coupled to the fin assemblies 600, to apply the required driving torque.

It is also apparent that at least in this example, since all the fin assemblies 600 are coupled to the same actuator plate 200, the fin assemblies 600 are effectively also coupled to one another via the actuator plate 200. Thus, the actuator plate 200 essentially synchronizes the deployment of the plurality of fin assemblies 600, which is another feature of at least this example of the fin deployment system. By being mechanically synchronized, the fin assemblies 600 will deploy in the same, synchronized, manner even if the torque applicator 700 is only partially effective and does not apply the same opening torque to all the fin assemblies 600.

In alternative variations of this example, the torque applicator 700 is instead configured for acting directly on the actuator plate 200, when this is unlocked, and thus, via the coupling with the fin assemblies 600, also results in the vane assemblies deploying from the stowed position to the deployed positions. For example, such a torque applicator can comprise at least one of a torsion bar or torsion spring coupled to the actuator plate 200, and pre-stressed or otherwise biased to apply the driving torque to the actuator plate 200 directly, to thereby pivot the actuator plate 200 from the first pivot position P1 to the second pivot position P2, responsive to the actuator plate 200 being unlocked from the first pivot position P1, and concurrently pivot the fins 650 to the respective deployed positions DP. Alternatively, for example, the torque applicator can comprise at least one of a hydraulic, pneumatic or pyrotechnic actuator, suitably coupled to the actuator plate 200, to apply the required driving torque.

It is to be noted that in some alternative variations of the illustrated example, the torque applicator can be omitted, and the pivoting of the fin assemblies can be accomplished by suitably rolling\spinning the projectile 1, and thus the system 100, about the longitudinal axis LA. Thus, the centripetal force generated by the spinning deploys the fin assemblies 600, once the actuator plate 200 is unlocked from the first pivot position P1, and the deployment of the fins 5650 drives the actuator plate 200 via the coupling, to pivot the actuator plate 200 to the second pivot position P1.

Operation of the fin deployment system example 100 illustrated in FIGS. 1(*a*) to 6(*b*) is as follows, for example. In the stowed position illustrated in FIGS. 1(*a*), 2(*a*), 3(*a*), 4(*a*), 5(*a*), the actuator plate 200 is locked in the first pivot position P1 by the engagement of the pins 330 in the holes 340, of the first mechanical stop arrangement 300. The coupling between the actuator plate 200 and the fin assemblies 600 also locks or maintains the fin assemblies in the stowed position SP. When it is desired to deploy the fins assemblies 600, the control command signal is sent to the actuation assembly 500, and in particular to the pyrotechnic component 560 to fire the same. This control command signal can originate from a controller (not shown), which can be, for example, any suitable electronic, computer or other controller, or comprise a simple timer, for example set for sending the control command signal a preset time after the projectile 1 is launched. Such a signal can be electric or electronic or digital, depending on the controller and the pyrotechnic component. Firing of the pyrotechnic component results in the generation of pressure on one end of the piston 510, and displaces the piston 510 from position A1 to position A2, which in turn displaces the pin support bracket 320 by displacement s, thereby disengaging the pins 330 from the holes 340, and thereby unlocking the actuator plate 200 from the first pivot position P1. Once unlocked, the torque applicator 700 applies a torque to the fin assemblies, deploying the fin assemblies 600 to the deployed positions DP, illustrated in FIGS. 1(*b*), 2(*b*), 3(*b*), 4(*b*), 5(*b*), and concurrently, via the coupling with the actuator plate 200, the actuator plate pivots about the longitudinal axis LA to the second pivot position P2. As this pivoting is progressing, the moderate slopes 422, 442 of each pair of aligned first teeth 420 and second teeth 440 slide over one another displacing the actuator plate 200 axially away from the inner support bracket 160, and compressing the spring 450 (FIG. 6(*a*)). At the second pivot position P2, the respective steep slopes 424, 444 of the first tooth 420 and the second tooth 440 come into abutting contact, biased by the spring 450, and preventing relative rotation between the actuator plate 200 and the inner support bracket 160 back from the second pivot position P2 to the first pivot position P1, thereby locking the fin assemblies 600 in the deployed position.

It should be noted that the word "comprising" as used throughout the appended claims is to be interpreted to mean "including but not limited to".

While there has been shown and disclosed examples in accordance with the presently disclosed subject matter, it will be appreciated that many changes may be made therein without departing from the spirit of the presently disclosed subject matter.

The invention claimed is:

1. A fin deployment system for a projectile, the fin deployment system defining a longitudinal axis, the fin deployment system comprising:

an actuator plate, pivotable from a first pivot position to a second pivot position about the longitudinal axis;

a first mechanical stop arrangement, configured for initially locking the actuator plate at the first pivot position, and for selectively unlocking the actuator plate from the first pivot position responsive to an actuating force to thereby allow the actuator plate to pivot to the second pivot position;

an actuation assembly for selectively applying the actuating force to the first mechanical stop arrangement to thereby unlock the actuator plate from the first pivot position;

a plurality of fin assemblies, each of the plurality of fin assemblies including a fin pivotable from a stowed position to a deployed position about a respective fin hinge defining a respective deployment axis, each of the plurality of fin assemblies forming a kinematic pair with the actuator plate such that said pivoting of the actuator plate between the first pivot position and the second pivot position, and said pivoting of each fin from the respective said stowed position to the respective said deployed position, are concurrent; and a second mechanical stop arrangement for locking the fin assemblies in the respective deployed positions responsive to the actuator plate pivoting from the first pivot position to the second pivot position.

2. The fin deployment system according to claim 1, further comprising:

an outer casing; and an inner support bracket internally mounted to outer casing;

wherein the plurality of fin assemblies are pivotably mounted to the outer casing about the respective deployment axes;

wherein the actuation assembly is mounted to the inner support bracket.

3. The fin deployment system according to claim 2, wherein the actuation assembly is configured for selectively applying the actuating force to the first mechanical stop arrangement along an axial direction parallel to the longitudinal axis, to thereby unlock the actuator plate from the first pivot position.

4. The fin deployment system according to claim 3, wherein the actuation assembly comprises an actuation piston, axially displaceable with respect to the inner support bracket from a first axial position to a second axial position.

5. The fin deployment system according to claim 4, wherein the actuation assembly comprises a pyrotechnic component operable for selectively displacing the actuation piston to the second axial position when fired.

6. The fin deployment system according to claim 5, wherein the first mechanical stop arrangement comprises a pin support bracket carrying at least one pin and mounted with respect to the inner support bracket to prevent relative rotation of the pin support bracket about the longitudinal axis, the at least one pin being engaged in a complementary hole provided in the actuator plate when the actuator plate is in the first pivot position to thereby lock the actuator plate with respect to the inner support bracket in the first pivot position, the pin support bracket being selectively axially displaceable responsive to actuation of the actuation piston to disengage the at least one pin from the complementary hole and to thereby unlock the actuator plate from the first pivot position.

7. The fin deployment system according to claim 6, wherein:

the pin support bracket is affixed to one end of the actuation piston;

in said first axial position the at least one pin is engaged in the complementary hole; and in said second axial position, the at least one pin is disengaged from the complementary hole.

8. The fin deployment system according to claim 1, wherein the second mechanical stop arrangement is configured for locking the plurality of fin assemblies in the respective deployed positions responsive to the actuator plate pivoting from the first pivot position to the second pivot position, by mechanically locking the actuator plate in the second pivot position.

9. The fin deployment system according to claim 8, wherein the second mechanical stop arrangement comprises at least one first tooth provided on the actuator plate in a general overlying abutting relationship with at least one second tooth provided on the inner support bracket, said at least one first tooth and said at least one second tooth having a respective moderate slope and a respective steep slope, wherein in said first pivot position the respective moderate slopes are in abutting contact, permitting relative rotation between the actuator plate and the inner support bracket about the longitudinal axis to the second pivot position, and wherein in said second pivot position, the respective steep slopes of the at least one first tooth and the at least one second tooth are in abutting contact, preventing relative rotation between the actuator plate and the inner support bracket from the second pivot position to the first pivot position.

10. The fin deployment system according to claim 9, further comprising a biasing spring for biasing the actuator plate towards the inner support bracket.

11. The fin deployment system according to claim 10, wherein the biasing spring further biases the respective steep slopes of the at least one first tooth and the at least one second tooth into abutting contact in said second pivot position.

12. The fin deployment system according to claim 2, wherein the actuation plate is pivotably mounted with respect to the inner support bracket.

13. The fin deployment system according to claim 1, wherein the actuator plate comprises a plurality of radial through-slots corresponding to the plurality of fin assemblies, each of the plurality of fin assemblies comprising an actuating arm rigidly mounted to a root of the respective fin and comprising an axial pin spaced from the fin root, the axial pin being received in the respective said through-slot and radially movable with respect to the respective slot concurrently with pivoting of the actuator plate from the first pivot position to the second pivot position to thereby concurrently pivot the respective fin from the stowed position to the deployed position.

14. The fin deployment system according to claim 1, further comprising:

a torque applicator configured for applying a driving torque to at least one of the actuator plate and the plurality of fin assemblies, to thereby pivot the actuator plate from the first pivot position to the second pivot position, responsive to the actuator plate being unlocked from the first pivot position.

15. The fin deployment system according to claim 14, wherein the torque applicator comprises at least one of a torsion bar or torsion spring at each fin hinge and biased to apply the driving torque to the respective fin assembly, to thereby pivot the respective fin to the deployed position, and concurrently pivot the actuator plate from the first pivot position to the second pivot position, responsive to the actuator plate being unlocked from the first pivot position.

16. The fin deployment system according to claim 14, wherein the torque applicator comprises at least one of a torsion bar or torsion spring coupled to the actuator plate, and biased to apply the driving torque to the actuator plate, to thereby pivot the actuator plate from the first pivot position to the second pivot position, responsive to the actuator plate being unlocked from the first pivot position, and concurrently pivot the fins to the respective deployed positions.

17. The fin deployment system according to claim 1, wherein said fins are wrap-around fins having a first side and a second side, wherein in the respective stowed configuration the respective fins are in wrapped configuration, wherein said first sides of the fins are in overlying relationship with the outer casing, and wherein in said deployed configuration, the fins project generally radially with respect to the longitudinal axis.

18. The fin deployment system according to claim 1, wherein said deployment axes are parallel to, and radially spaced from, said longitudinal axis.

19. The fin deployment system according to claim 1, wherein each fin comprises an elongate curved body.

20. The fin deployment system according to claim 2, wherein in the stowed position, the fins are cylindrically disposed over the outer casing to provide a cylindrical body having a diameter of 120 mm.

21. A projectile, comprising at least one of the fin deployment systems as defined in claim 1.

22. The projectile according to claim 21, the projectile being configured for being cannon-launched.

23. The projectile according to claim 21, the projectile being a 120 mm gun munition.

24. The projectile according to claim 21, wherein one said fin deployment system is located at the center of gravity of the projectile.

25. The projectile according to claim 21, wherein one said fin deployment system is located in an aft portion of the projectile.

* * * * *